US006824002B1

(12) United States Patent
Hadland

(10) Patent No.: US 6,824,002 B1
(45) Date of Patent: Nov. 30, 2004

(54) SUPPORT FIXTURE FOR FOOD PLATE AND BEVERAGE CONTAINER

(76) Inventor: Wayne Oliver Hadland, P.O. Box 88, Sweet Home, OR (US) 97386-0088

( * ) Notice: Subject to any disclaimer, the term of this patent is extended or adjusted under 35 U.S.C. 154(b) by 0 days.

(21) Appl. No.: 10/676,291

(22) Filed: Sep. 30, 2003

(51) Int. Cl.[7] ..... B65D 21/02

(52) U.S. Cl. ..... 220/23.83; 220/737; 220/738; 220/756; 206/216; 206/549; 229/4.5

(58) Field of Search ..... 206/223, 541, 206/557, 561, 562, 216, 217, 218, 549; 211/129.1; 248/309.1, 310, 311.2, 312.1, 174; 220/23.8, 23.83, 23.86, 23.88, 23.89, 756, 771, 737, 738, 739; 229/4.5, 5.5, 93, 406, 407

(56) References Cited

U.S. PATENT DOCUMENTS

| | | | | |
|---|---|---|---|---|
| 2,117,102 A | | 5/1938 | Pittler | |
| 2,561,022 A | | 7/1951 | Jones | |
| 2,582,183 A | | 1/1952 | Weidler | |
| 3,955,672 A | * | 5/1976 | Brundage | 206/562 |
| 4,534,469 A | | 8/1985 | Elsmo | |
| 4,823,958 A | | 4/1989 | Mahmud | |
| 5,058,737 A | | 10/1991 | Patterson et al. | |
| 5,060,820 A | | 10/1991 | Boerner | |
| 5,170,908 A | | 12/1992 | Austin | |
| 5,176,283 A | | 1/1993 | Patterson et al. | |
| 5,205,473 A | | 4/1993 | Coffin, Sr. | |
| 5,207,743 A | | 5/1993 | Costarella et al. | |
| 5,234,125 A | | 8/1993 | Roberts | |
| 5,240,136 A | | 8/1993 | Patterson et al. | |
| 5,249,700 A | | 10/1993 | Dumke | |
| 5,292,028 A | | 3/1994 | Patterson et al. | |
| 5,353,952 A | | 10/1994 | Donche | |
| 5,429,231 A | | 7/1995 | McSpadden | |
| 5,441,164 A | | 8/1995 | Beck et al. | |
| 6,446,828 B1 | * | 9/2002 | Casteel | 220/575 |

* cited by examiner

*Primary Examiner*—Lee Young
*Assistant Examiner*—Harry Grosso

(57) ABSTRACT

A disposable fixture for supporting a beverage container and for supporting a food plate having a central hole approximately three inches in diameter, suitable for holding with one hand. In the preferred embodiment the fixture is made entirely of corrugated fiberboard (aka corrugated cardboard) and, except for two rubber bands, requires no fasteners (e.g., glue, tape, or staples). The fixture can support several kinds of beverage containers without needing modifications or additional parts. All unassembled parts can be laid flat so as to take up minimal storage space. The fixture weighs approximately two ounces.

12 Claims, 7 Drawing Sheets

SUPPORT FIXTURE FOR FOOD PLATE AND BEVERAGE CONTAINER

CROSS-REFERENCE TO RELATED APPLICATIONS

Will file a design patent application on the food plate shown in FIG. 11; this food plate is not a part of the present invention.

FEDERALLY SPONSORED RESEARCH

Not Applicable

SEQUENCE LISTING OR PROGRAM

Not Applicable

BACKGROUND OF THE INVENTION

1. Field of the Invention

This invention relates to articles of manufacture intended to support a food plate and a beverage container, more particularly to disposable support fixtures fabricated from corrugated fiberboard that are suited to be held by one hand.

2. Discussion of Prior Art

A number of situations exist where food and beverages are served but where there are no tables or flat surfaces nearby suitable for resting a food plate and a beverage container. A few examples are picnics, fairs, festivals, athletic events, car shows, and walk-up or drive-up fast food establishments. If one is standing up while eating a kind of food that is normally only served on a plate, one will find it awkward to hold both a plate and a beverage container during the process.

A number of patents have issued disclosing various means for overcoming this problem. Most have focused on the plate or on the plate and beverage container combination. Following are a few examples of such disclosures.

Four U.S. Pat. Nos. 5,058,737 (1991), 5,176,283 (1993), 5,240,136 (1993), and 5,292,028 (1994), all to Patterson et al., disclose means to suspend a beverage container underneath a food plate. The first three show a progression of plates with underside fitments of various types disposed to accept beverage containers having corresponding upper edges. The fourth (the '028) discloses a holder (which surrounds the edge of a plate) that suspends a beverage container underneath a plate by similar means. It appears that the plate or the holder is the object intended to be gripped by one hand. It does not appear that the holder disclosed is intended to be inexpensive or disposable.

U.S. Pat. No. 5,060,820 (1991) to Boerner discloses members attached to and descending from the bottom of a plate which fit over the top of a beverage container situated underneath the plate, thereby allowing a user to grasp both the beverage container and the plate members with one hand. Provided the food is evenly distributed on the plate it seems useful for the task of holding the plate and beverage container together in one hand, but it appears it might be awkward to engage, disengage, and then engage once again a nearly full beverage container with a full plate of food.

U.S. Pat. No. 5,249,700 (1993) to Dumke discloses a plate with a central hole that accepts an interfitting tapered beverage container. U.S. Pat. No. 5,207,743 (1993) to Costarella et al. discloses another plate with a central hole that accepts a tapered beverage container that has a double curvature to the edge of the hole so that the plate can thereby be grasped by the thumb and fingers and be supported centrally from underneath. Both accept only a certain kind of beverage container, and the latter ('743) appears uncomfortable to hold for more than a short time.

U.S. Pat. No. 5,205,473 (1993) to Coffin, Sr., discloses the use of corrugated fiberboard, both for a beverage container per se and also for an insulating surround for a beverage container. It does not teach the use of corrugated fiberboard for a support fixture, much less the use for a support fixture for both a food plate and a beverage container.

OBJECTS, FEATURES, AND ADVANTAGES

It is an object of the present invention to provide a support fixture for supporting a food plate and a beverage container.

It is another object of the present invention that the support fixture can be naturally and comfortably held in one hand while supporting a food plate and beverage container.

It is another object of the present invention that the hand holding the support fixture can remain in a fixed position (e.g., the beverage container can be removed and replaced without affecting the holding hand).

It is another object of the present invention that the support fixture accommodate a variety of beverage containers.

It is another object of the present invention that the support fixture be light weight.

It is another object of the present invention that the support fixture be inexpensive.

It is another object of the present invention that the support fixture be simple and quickly and easily assembled without the need for tape, glue, or staples.

It is another object of the present invention that the unassembled support fixture components take up little space.

It is another object of the present invention that the support fixture be made of materials commonly and widely available nationwide in large quantities.

It is another object of the present invention that the support fixture be made of materials that are disposable, recyclable and biodegradable.

It is a feature of the support fixture that (except for two identical rubber bands) it is constructed entirely of Domestic (class) uncoated corrugated fiberboard, which itself is made from kraft unbleached paperboard produced from wood fibers.

It is a feature of the support fixture that it is held by gripping a tactilely comfortable corrugated cylindrical stem, in the same natural manner as holding a metal can of beer.

It is a feature of the support fixture that it supports the food plate and beverage container directly above the hand gripping the cylindrical stem; i.e., they are coaxially supported.

It is a feature of the support fixture that it is composed of few parts, all of them being symmetrical, to minimize the possibility of incorrect assembly.

It is an advantage of the support fixture that it weighs merely two ounces.

It is an advantage of the support fixture that a beer or soda pop can (or such other similar cylindrical object) is the only tool one needs for assembly.

It is an advantage of the support fixture that it can support several kinds of beverage containers without needing modifications or additional parts.

It is an advantage of the support fixture that it can be used to support ordinary paper plates, by simply cutting a three inch diameter hole in the center of the paper plate and, if desired, wrapping a paper napkin or waxed paper or other such suitable material around the base of the fixture hub.

SUMMARY

In accordance with the above-stated objects, features, and advantages the present invention provides a light-weight, economical, disposable, and practical support fixture that enables a person to conveniently and comfortably hold a food plate and beverage container with only one hand. Being a separate fixture that is neither a part of the food plate nor the beverage container, it enables a person to eat from the food plate or to pick up and drink from the beverage container without affecting the placement of the hand holding the fixture or requiring the performance of some awkward maneuver. The support fixture can support several common kinds of beverage containers without any modifications or additional parts. A hole approximately three inches in diameter is required in the center of the food plate; a common disposable paper plate can be accommodated by simply cutting a hole with a scissors or crossed slices (e.g., an "X") with a knife in the middle of the paper plate.

In the preferred embodiment the fixture is made entirely of corrugated fiberboard (aka corrugated cardboard) and, except for two rubber bands, requires no fasteners (e.g., glue, tape, or staples). The fixture weighs approximately two ounces. All unassembled parts can be laid flat so as to take up minimal storage space. The fixture is comprised of two main parts; a grippable cylindrical assembly which supports both a beverage container and a plate support platform, and a plate support platform which fits tightly over the upper end of the cylindrical assembly.

DRAWINGS—BRIEF DESCRIPTION

The following abbreviations are used in the specification:

"aka" for "also known as"

"CF" for "corrugated fiberboard"

"DF" for "double-face"

"SF" for "single-face"

FIG. 1 shows an isometric view of the support fixture, here shown supporting an example of a suitable round food plate having a central hole (this food plate is not part of the instant invention), and also shown supporting an example of a typical metal-can beverage container. A sector is cut out from the food plate to reveal an underlying plate support platform (shown as a disk), which in turn is partially cut away at the center (crescent-shaped piece removed) to reveal a shoulder which supports the platform.

DRAWING—REFERENCE NUMERALS

Figure 1:
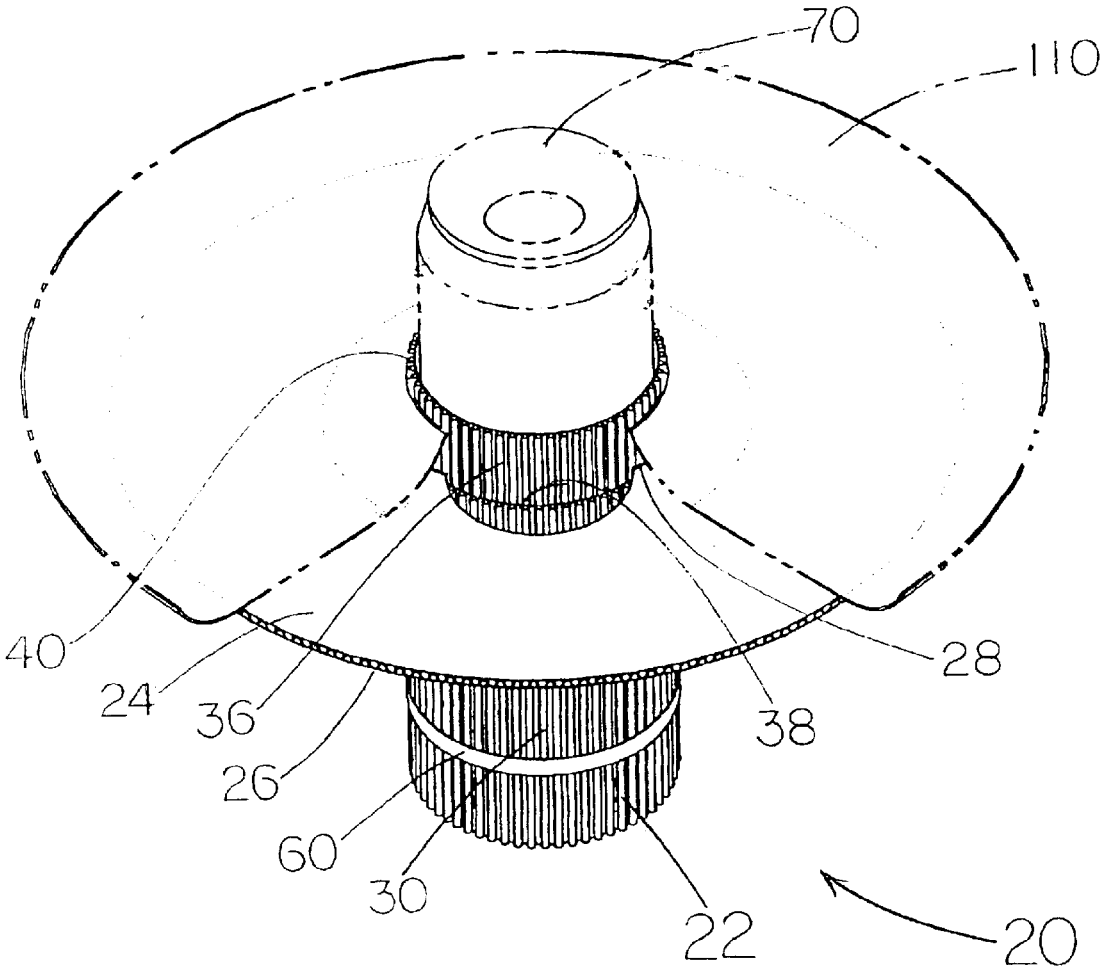

20 support fixture
22 cylindrical assembly
24 plate support platform of DF CF
26 plate support platform outer edge
28 plate support platform inner edge
30 cylinder stem
31 cylinder, aka cylinder wall
32 cylinder wall inner wrap of SF CF
34 cylinder wall outer wrap of SF CF
36 cylinder hub
38 cylinder outer shoulder aka upper edge of outer wrap
40 cylinder rim
42 cylinder lip
43 cylinder inner ledge
44 strip of SF CF used to form cylinder wall
46 smooth (i.e., facing) side of flat strip
47 projecting ears of flat strip
48 corrugated medium side of flat strip
50 lower bulkhead disk
51 outer edge of lower bulkhead disk
52 inner edge of lower bulkhead disk
54 upper bulkhead disk
55 outer edge of upper bulkhead disk
56 inner edge of upper bulkhead disk
58 spacer (shown as a coiled strip of SF CF)
60 elastic means for squeezing (shown as two rubber bands)
70 representation of a typical metal beverage can
80 representation of a polystyrene foam cup
82 step in outside conical surface of a foam cup
90 representation of a disposable plastic tumbler
100 representation of a stemmed wine glass
110 representation of a suitable food plate

112 inner turned-up edge of food plate defining hole
114 outer turned-up edge of food plate
120 representation of a suitable cylindrical mandrel
122 mandrel body
124 mandrel handle
126 mandrel stub
130 representation of cross-section of SF CF
132 representation of facing aka linerboard
134 representation of corrugated (i.e., fluted) medium
140 representation of cross-section of DF CF
142 representation of facing aka linerboard
144 representation of corrugated (i.e., fluted) medium

DETAILED DESCRIPTION OF THE PREFERRED EMBODIMENT

Before proceeding with the detailed description it is necessary first to identify the reference standard for the terminology used herein pertaining to corrugated fiberboard, then discuss the specific corrugated fiberboard products selected, and finally describe in a general broad overview the structural design of the support fixture.

The American Society for Testing and Materials (hereinafter ASTM) Standard D996-02 entitled "Standard Terminology of Packaging and Distribution Environments" is the dictionary (22 pages long) relied upon in writing the specification and claims.

The following abbreviations are used herein:

"aka" for "also known as"

"CF" for "corrugated fiberboard"

"DF" for "double face" "SF" for "single face"

Figure 13:
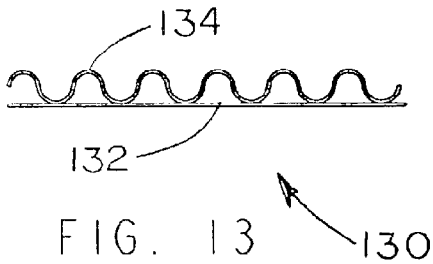
FIG. 13 is an illustrative cross-sectional view of a flat strip of single-face corrugated fiberboard (SF CF), looking in the direction of the flutes.

FIG. 13 is an illustrative cross-sectional view of a flat strip of single-face corrugated fiberboard (SF CF) 130, looking in the direction of the flutes. It consists of a single flat sheet of paperboard called facing (aka linerboard) 132, and a fluted sheet of paperboard called corrugated medium 134. The word strip is used here (instead of sheet) because SF CF is usually supplied in roll form rather than as flat single sheets.

Figure 14:
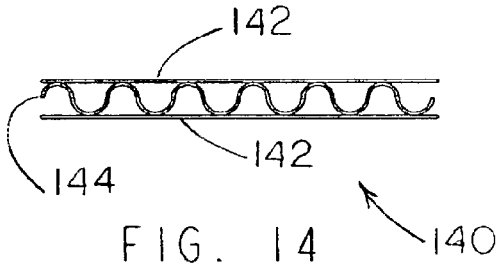
FIG. 14 is an illustrative cross-sectional view of a flat sheet of double-face (aka single wall) corrugated fiberboard (DF CF), looking in the direction of the flutes.

FIG. 14 is an illustrative cross-sectional view of a flat sheet of double-face (aka single wall) corrugated fiberboard (DF CF) 140, looking in the direction of the flutes. It consists of a corrugated medium 144 sandwiched between two facings 142.

ASTM D4727/D4727M-98 entitled "Standard Specification for Corrugated and Solid Fiberboard Sheet Stock (Container Grade) and Cut Shapes," and ASTM D5639/D5639M-95 entitled "Standard Practice for Selection of Corrugated Fiberboard and Box Construction Based on Performance Requirements," were utilized in selecting the kinds of corrugated fiberboard used for the preferred embodiment and for describing that selection herein. Corrugated fiberboard is an engineered product primarily used for making boxes, and numerous standards and test procedures have been developed by several entities over the years; the above ASTM standards cite many of these other standards and test procedures. The present invention exploits the advantages of using particular kinds of corrugated fiberboard as the material of construction for the support fixture.

The flat members of the preferred embodiment of the fixture are made of double-face (i.e., single-wall) corrugated fiberboard specified in accordance with ASTM D4727/D4727M-98, viz: Type: Corrugated Fiberboard; Class: Domestic; Variety: Single Wall; Grade: 200; Flute type: C. Additionally the paperboard of which it is constructed should be unbleached and uncoated kraft paper.

Double-face (i.e., single-wall) corrugated fiberboard meeting these specifications is widely available because it is commonly used for making boxes. The four commonly used flute types, in order of decreasing flute height (approximate, in inches) are: "A" (about 3/16), "C" (about 9/64), "B" (about 3/32), and "E" (about 3/64). Flute type "C" (rather than "A") is chosen for the DF CF because it is more widely available, and because it is better suited for die cutting. Identifying the flute size by type (i.e., by the letter A, C, B, or E) specifies not only the flute height but also the spacing (in number of flutes per foot).

The curved member of the preferred embodiment of the fixture, the cylinder 31 (aka cylinder wall) is made of single-face corrugated fiberboard (SF CF), often supplied in roll form. It is by design flexible in one direction and stiff in the perpendicular direction, hence it is not suitable for making boxes but is rather used as a wrapping or packaging material. Consequently there are fewer standards pertaining to single face as compared to double face corrugated fiberboard. A GSA Commercial Item Description A—A-1051C pertains only to a particular "B" flute construction and uses its own peculiar definition of basis weight; the standard it superseded (Federal Specification PPP-P-291) had the same drawbacks but was more extensive and educational. Consequently more detail must be used in specifying SF CF or a manufacturer found that makes a suitable kind as a stock item. Sf CF having size "A" flute and made of kraft paperboard within the range of 50 to 100 pound basis weight (pounds per thousand square feet) for both the facing and the corrugated medium would be suitable. On the west coast the F-D-S Manufacturing Company, Inc., located in Pomona, California, is one such source. Suitable SF CF standard products made of unbleached kraft paperboard in "A" flute size and in two usable paperboard basis weights (pounds per thousand square feet) can be obtained from F-D-S. The lighter-weight product is made of 50 pound basis weight paperboard for both the facing and the corrugated medium (designated 50#/50# herein); the heavier-weight product is made of 70 pound basis weight paperboard (designated 70#/70# herein). The 70#/70# costs about twenty-five percent more than the 50#/50# but is preferred; the 50#/50# is the bottom end of the acceptable basis weight range. A source for 70#/70# SF CF in the eastern part of the country is the Ivex Packaging Corporation (a subsidiary of the Alcoa Corporation) located in Brideview, Ill.

Rubber bands are another seemingly fungible product, but the elastic properties of different brands of rubber bands of the same size vary widely. For this reason the particular kind of rubber band 60 used for the preferred embodiment is specified not only by the trade size 64, but is more particularly hereby specified by both the physical measurements (nominal dimensions ¼ inch wide by 1/32 inch thick band cross-section by 3½ inch long closed-flat loop length) and by the applicable Federal Government GSA Commercial Item Description A—A-131B.

The reason for this specificity is to control the amount of squeezing force rubber bands 60 exert on the two wrappings of SF CF forming cylinder wall 31 of the support fixture. Too much squeezing force may crush the flutes (especially if 50#/50# basis weight SF CF is used). United Stationers distributes, under their Plymouth brand name, size 64 rubber bands meeting the GSA specification in one-pound boxes; another source is the AERO Rubber Company of Bridgeview, Ill.

Generally speaking (from a structural engineering viewpoint) the support fixture is a monocoque structure, similar in concept to the configuration of an airplane fuselage. Cylinder wall 31 serves as a shell. The rubber bands 60 squeeze the shell into contact with the two bulkhead disks 50

& 54, and the tightly-fitting platform 24 serves as an exterior stiffening ring, thus providing a very lightweight yet stiff support fixture structure.

The terms "cylinder" and "cylinder wall" are used herein (both in the specification and in the claims) as identical synonyms, using the same reference numeral 31 as they are in fact the same member; the term used at any particular point in the text is what seems the most natural.

The word "cut" as used herein includes any method of cutting a part from a sheet or strip of corrugated fiberboard (e.g., die cutting, punching, laser cutting, cutting with a very high pressure stream of fluid or gas, etc.).

Having described in some detail the specific requirements for each kind (i.e., single-face and double-face) of corrugated fiberboard that the corrugated fiberboard components of the fixture are cut from, and having likewise described the rubber bands, the final chapter is simultaneously describing the components and how they are assembled.

Figure 15:
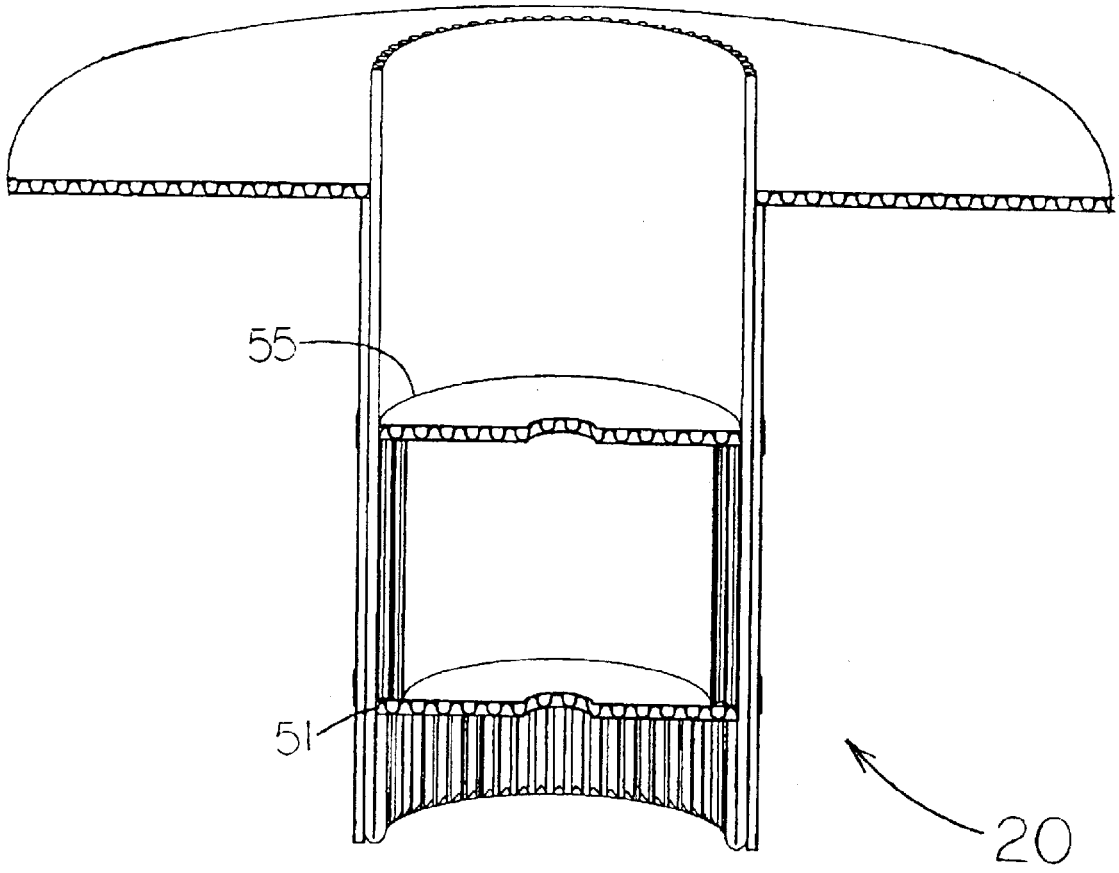
FIG. 15 is an isometric full cross-sectional view of the preferred embodiment of the support fixture, suitable for inclusion in the Official Gazette.

Referring now to the drawings wherein like reference numerals are used to designate like parts throughout the various figures, there is shown in FIG. 1 and FIG. 15 the support fixture 20 of the present invention. FIG. 15 is an isometric cross-sectional view of fixture 20 alone, suitable for publication in the Official Gazette.

FIG. 1 shows an isometric view of fixture 20 supporting a suitable round food plate 110 having a central hole and also supporting an example of a beverage container, in this instance a typical 12 fluid ounce metal beverage can 70. As neither food plate 110 nor beverage container 70 are part of the instant invention, they are drawn with phantom lines. A sector is broken out from food plate 110 to reveal an underlying plate support platform 24 (shown here as a round disk), which in turn is partially broken away at the center (a crescent-shaped piece removed) to reveal a shoulder 38 which supports platform 24.

Plate support platform 24 is cut from a sheet of DF CF; a reasonable and practical shape and size for platform 24 is a round disk of approximately 9 inches outside diameter with a central hole defined by inner edge 28, as depicted in FIGS. 1 and 15. However platform 24 is not limited to a reasonable shape and size nor is the location of the hole 28 limited; they are limited only by a minimum and maximum platform area enclosed by a closed outer edge 26. This is to accommodate imaginative platform shapes such as pumpkins and stars.

Figure 2:
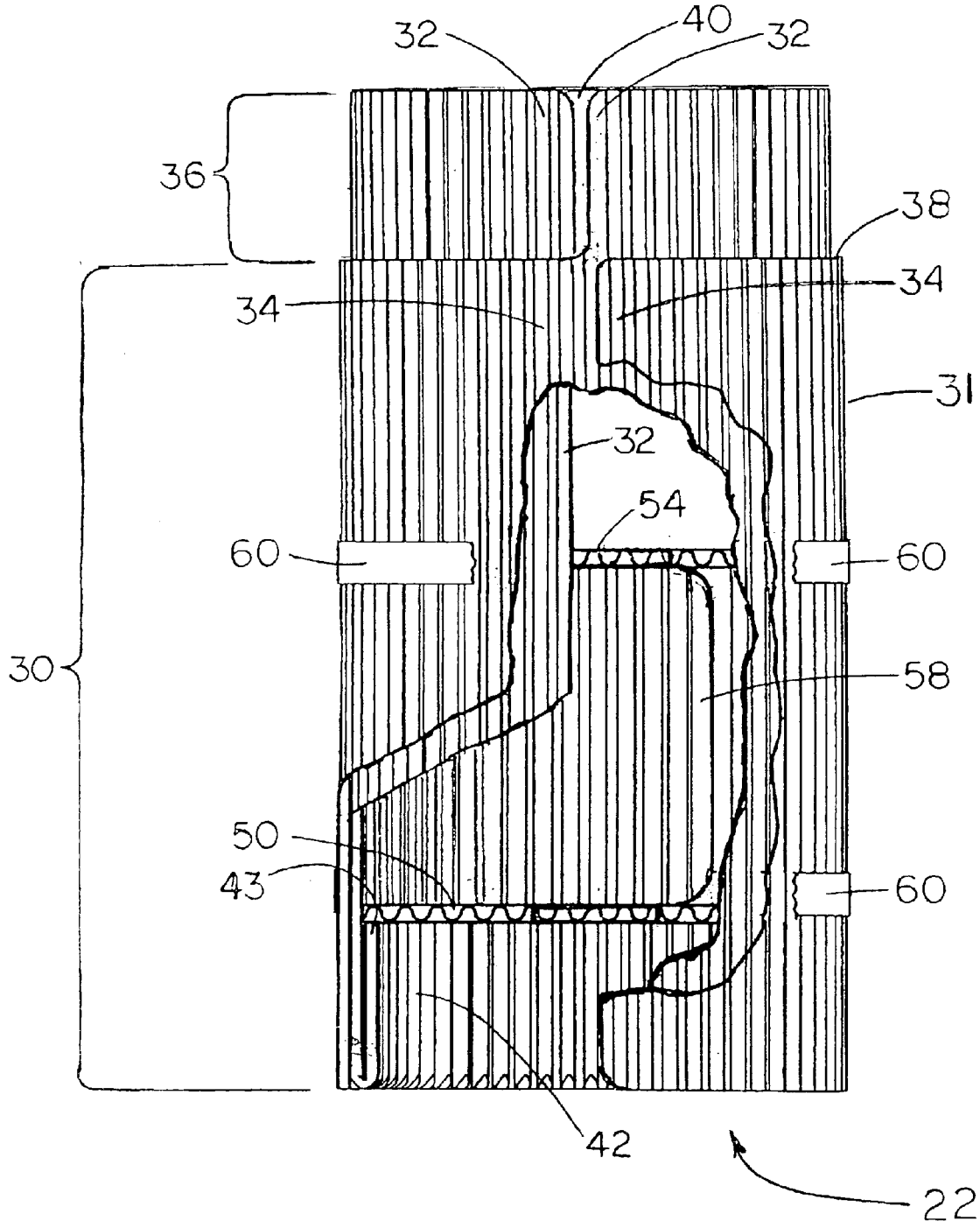
FIG. 2 is a drawing of solely the cylindrical assembly, having sequential cut-outs to reveal the layered form of the cylinder wall and the inner construction of the cylindrical assembly.
Figure 3:
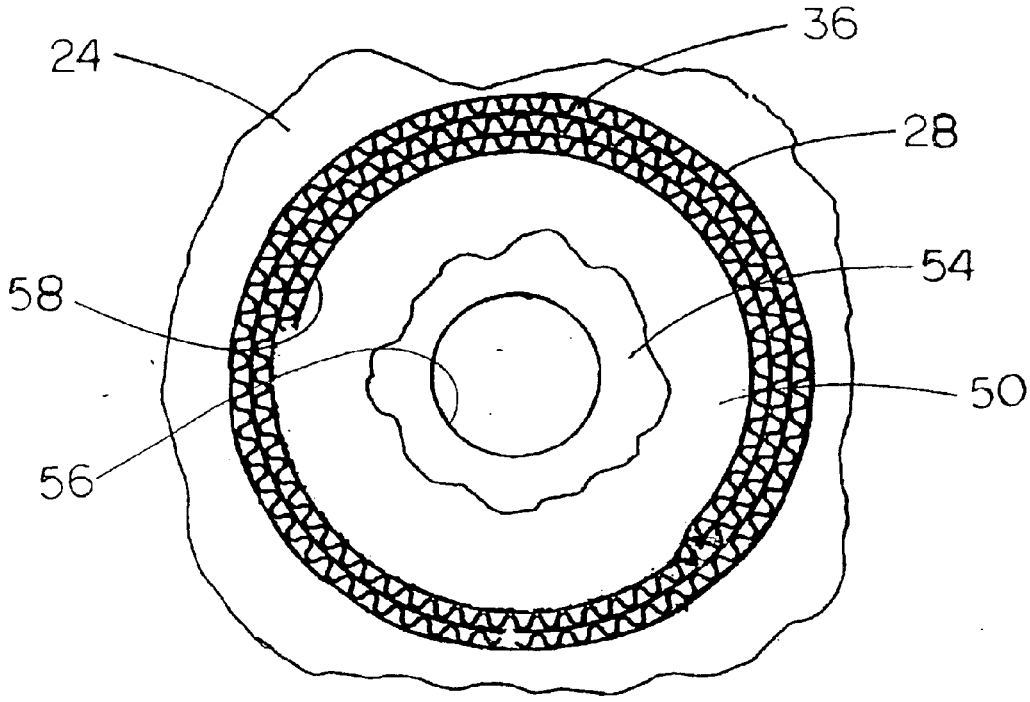
FIG. 3 is a top view of the cylindrical assembly shown in FIG. 2, but with the center portion of the plate support platform (outer portion of the platform is cut away) shown installed over the upper portion (hub) of the cylindrical assembly.
Figure 4:
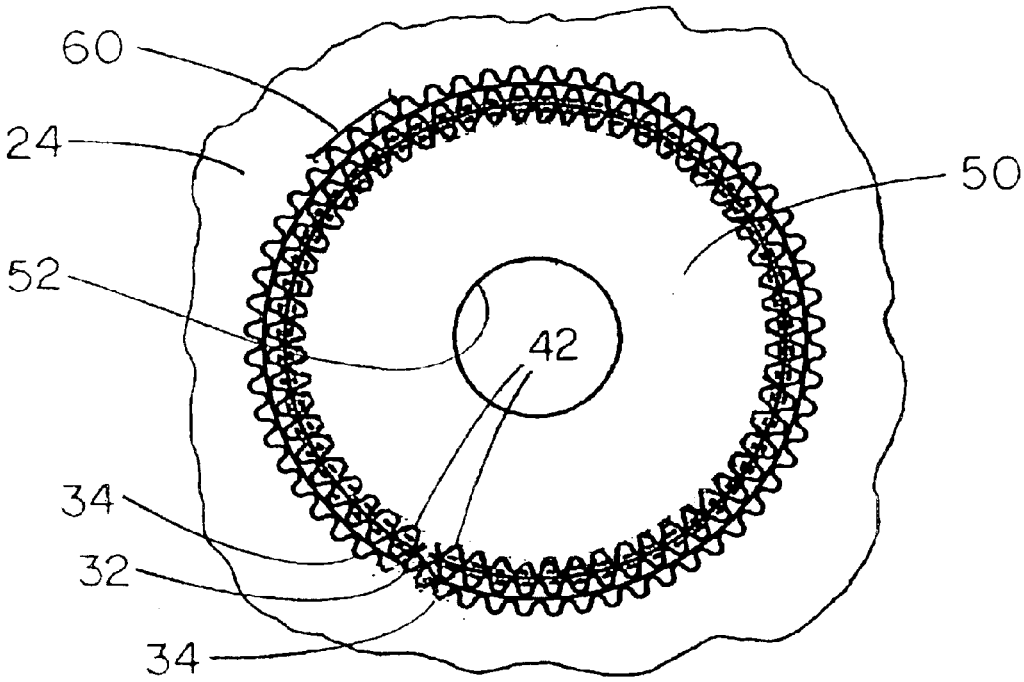
FIG. 4 is a bottom view of the cylindrical assembly shown in FIG. 2, but as in FIG. 3 also shown with the center portion of the plate support platform installed (outer portion of the platform is cut away).

FIG. 2 showing the cylindrical assembly 22 should be referred to in order to follow the ensuing descriptions. Portions of the two wraps of SF CF (inner wrap 32 and outer wrap 34) forming the cylinder wall 31 are broken away to reveal the inner details of cylindrical assembly 22. Referring to FIGS. 3 and 4, top and bottom views of cylindrical assembly 22 will also be helpful.

As support platform 24 is secured in place by compressing and deforming the axial flutes of hub 36 after platform 24 has been set in place over hub 36, the diameter of hole 28 in platform 24 depends on whether the cylinder 31 is constructed of 50#/50# or 70#/70# SF CF. The diameter of the outer edge 51 & 55 of identical bulkhead disks 50 & 54 also depends on the same factor. As determined by experiments, if cylinder wall 31 is made of preferred 70#/70# basis weight SF CF, then the diameter of platform hole 28 is 2⅞ inches; if lighter 50#/50# is used, the corresponding hole diameter is $2\frac{13}{16}$ inches. For identical bulkheads 50 & 54, the outside diameter for preferred 70#/70# cylinder construction is $2\frac{43}{64}$, and for 50#/50# $2\frac{41}{64}$. This set of circumstances comes about because the lighter flutes are reduced in height further than the heavier flutes to get approximately the same holding force on platform 24, and because the heavier flutes are stiffer so that although the flutes themselves are less reduced in height the cylinder wall 31 is deflected further inwards. Consequently a larger diameter hole 28 in platform 24, and larger bulkhead 50 & 54 outside diameters 51 & 55, are required when using preferred 70#/70# SF CF for construction of cylinder wall 31 than are required when using lighter weight 50#/50# SF CF construction in order to obtain approximately the same slip fit on a metal beverage can. The 50#/50# SF CF hub 36 flutes were reduced in height by roughly forty percent; the 70#/70# SF CF hub 36 flutes were reduced in height by roughly twenty percent (imprecise visual observation).

To reiterate, the sizes were determined by experimenting. It may well be that identical or very close basis weight SF CF obtained from different sources may require adjustments to these diameters. It should be kept in mind that fine precision is not attainable when working with corrugated fiberboard materials.

Bulkhead disks 50 & 54 are identical in every respect, plain circular disks cut from the same or identical sheet of DF CF as platform 24, having corresponding identical features, viz outer edge (OD) 51 & 55 and inner edge (ID) 52 & 56; they have been assigned different reference numerals solely to identify their position in various sectional assembly views (e.g., to identify whether the upper or lower bulkhead disk is cut away). The inner approximately ¾ inch diameter holes defined by inner edges 52 & 56 are required if one desires to use a mandrel 120 with a stub 126 to assemble cylinder wall 31. The outer edges 51 & 55 of each bulkhead 50 & 54 facing bite into cylinder wall 31 (as cylinder wall 31 is squeezed inwardly by rubber bands 60) which adds to the structural integrity of the cylindrical assembly 22. As the two-bulkhead 50 & 54 and one SF CF coiled-strip spacer 58 configuration illustrated in FIG. 2 is efficient, and prior to assembly takes up very little space, there is no valid reason to use a different configuration.

Nevertheless, the bulkheads 50 & 54 could be made from materials other than DF CF (e.g., wood, pressed wood pulp, polystyrene foam, etc.). In fact, the bulkheads 50 & 54 could be eliminated entirely by simply using a longer rigid cylindrical spacer 58 (made from material such as mentioned above, or even an empty can) that would rest directly on the cylinder wall inner ledge 43 and directly support the bottom of a beverage container. However this rigid-cylindrical-spacer 58 and no bulkheads configuration (although having fewer separate parts to assemble) would defeat one of the objects of this invention, namely to take up minimal space before assembly. A 2⅝ inch diameter by 2¼ inch long spacer 58 is bulky, almost half the size of a 12 fluid ounce beverage can.

Figure 5:
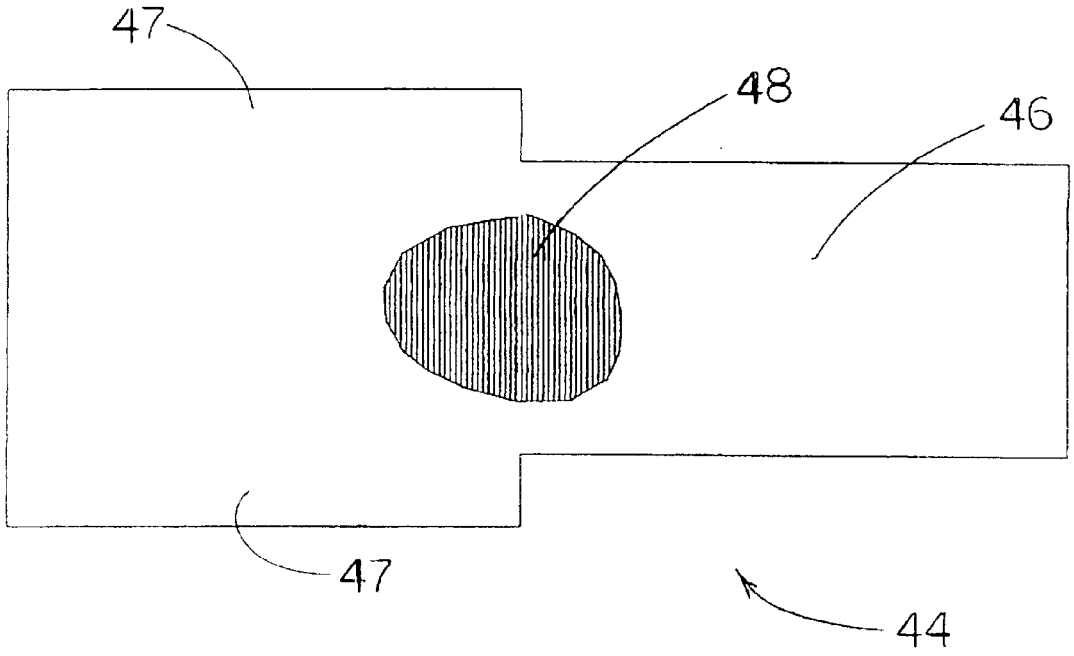
FIG. 5 is a view of the unrolled and unfolded strip of single-face corrugated fiberboard that forms the cylinder wall. The smooth near side (i.e., the facing) of the strip is shown broken away near the center to reveal the corrugated medium on the far side.
Figure 6:
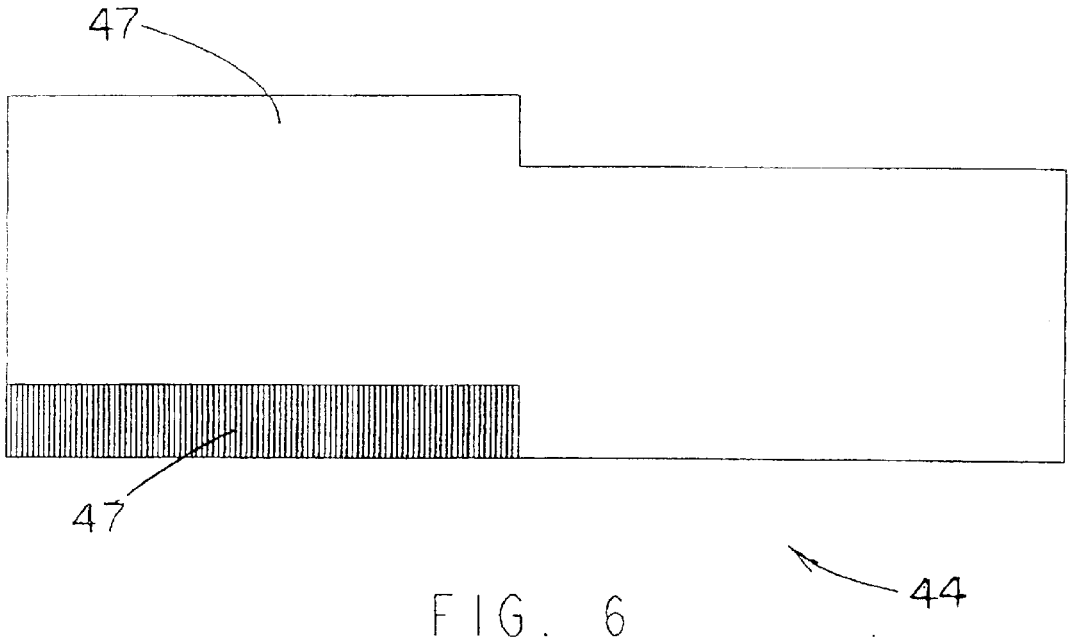
FIG. 6 is another view of the same strip of SF CF shown in FIG. 5, but with one of two ears completely folded over (to become the cylinder inner lip when the strip is wrapped around twice to form the cylinder wall).

FIG. 5 is a view of a flattened (i.e., unrolled and unfolded) strip 44 of single-face corrugated fiberboard that is used to form cylinder wall 31. The particular SF CF to be used has been previously discussed; one of the reasons why the largest flute size (size "A") was chosen was so that the exterior shoulder 38 and the inner ledge 43 would be as wide as possible. The smooth near side 46 (i.e., the facing) of strip 44 is shown broken away near the center to reveal the corrugated medium 48 on the far side. Strip 44 is bilaterally symmetrical and generally rectangular in shape, being approximately 7½ inches wide for an initial 8¼ inches of length and then stepped down to 5 inches in width for the remaining 9 inches in length, giving a total length of 17¼ inches. The step-down in width of 1¼ inches on each side gives the appearance of two rectangular tabs or ears 47 protruding from each side of the wider (ear) end. FIG. 6 is another view of strip 44; this view shows one of two ears 47 completely folded over, to become the cylinder 31 inner lip 42 when strip 44 is wrapped twice around a mandrel to form the cylinder wall. The mandrel can be a true mandrel tool such as mandrel 120 shown in FIG. 12, or a 2⅝ inch diameter metal beverage can may be used as a makeshift mandrel. If a large number of fixtures are to be assembled it is convenient to use a tool such as mandrel 120.

As strip 44 is symmetrical, it does not matter which ear 47 is folded over. As represented in FIG. 5, a right-handed person may fold over the lower ear 47, a left-handed person may fold over the upper ear 47 for greater convenience in rolling (starting at the wide end). Also due to symmetry, strips 44 may be packaged with the corrugated sides of each pair of strips interlaced with each other, to both reduce packaging height and to provide greater resistance to flattening of the flutes due to stacking while in transit and in storage.

The preferred spacer 58 is simply a 2 inch wide by approximately 16 inches long strip of "A" flute size single-face corrugated fiberboard rolled into a coil. It is better to have the flutes on the outside of the coil, to prevent any portion of the facing from falling into a gap between the bulkhead edge and cylinder and becoming ineffective. F-D-S Manufacturing Company manufactures 2 inch wide rolls of both 50#/50# and 70#/70# as a standard product. As 50#/50# is less expensive it will suffice for spacer 58. Being hollow, SF CF spacer 58 will not interfere with mandrel 120 stub 126 if it is used to insert upper bulkhead 54. Obviously other kinds of spacers could be used (e.g., wood, pressed wood pulp, polystyrene foam, etc.) but all would take up much more storage space (before assembly) than a pair of inter-laced two-inch wide strips of SF CF.

To summarize the assembly method intertwined in the foregoing description (and to elaborate further), it includes the following procedures. Place SF CF strip 44 corrugated side down on a table or other flat surface, then fold completely over whichever ear 47 is the more convenient so that the corrugated side of the folded-over ear remains exposed. Particularly if 70#/70# SF CF is used, it will be best to crush the flutes flat on the opposite side of the fold line before folding. After the fold is made the flutes at the fold line can be pinched together for a neat appearance. Next place a cylindrical mandrel about 2⅝ inches in diameter (generic mandrel—either a metal beverage can or a tool such as mandrel 120 shown in FIG. 12 can be used as the mandrel) on the smooth side of strip 44 at the wide end with a round end of the mandrel near the edge of the folded-over ear 47. Place a first bulkhead disk (that will become lower bulkhead disk 50 when assembly is completed) between the edge of the folded-over ear 47 and the round end of the mandrel. Holding the first bulkhead disk against the round end of the mandrel with the thumb of one hand, begin rolling strip 44 over the mandrel with the other hand. As the mandrel is about to be encircled remove the hand holding the first bulkhead disk against the end of the mandrel so that strip 44 can wrap twice around the mandrel; this completes the forming of the cylinder 31, creating a hub 36 and a shoulder 38 at the upper end and a lip 42 and ledge 43 at the lower end. While still holding the cylinder 31, wrap a rubber band 60 around cylinder 31 near the location of the lower bulkhead disk 50 (by definition the first bulkhead disk has now become lower bulkhead disk 50). Now pull out the mandrel. Insert spacer 58 into cylinder 31, followed by the second bulkhead disk (which becomes upper bulkhead disk 54 once inserted). Wrap a second rubber band 60 around the cylinder 31 near upper bulkhead disk 54. At this point the cylindrical assembly 22 has been completed. Grasp the cylinder stem 30 with one hand with your thumb on the side of hub 36. Pushing inwards while moving your thumb around the side of hub 36, insert the hub through hole 28 in plate support platform 24 so that plate support platform 24 becomes firmly seated against shoulder 38. The final step is inserting the mandrel into cylinder 31 to force the hub 36 flutes against the edge of hole 28 in platform 24 (the top tapered end of the beverage can should be inserted if the can is being used as a makeshift mandrel). As a result of this final step, the flutes of hub 36 are compressed against and deformed so as to slightly overlap both facings of the DF CF platform at the edge of the platform hole 28, so as to secure the platform 24 in position.

Figure 7:
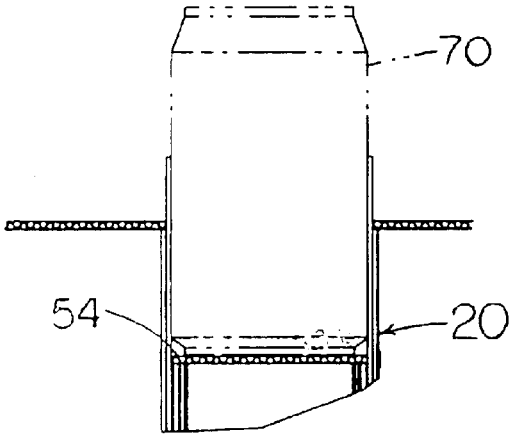
FIG. 7 is a cross-sectional view of the support fixture (with the stem and platform shown broken away) shown supporting a typical metal-can beverage container.

FIG. 7 is a cross-sectional view of support fixture 20 (with the stem 30 and plate support platform 24 shown broken away) shown supporting a typical 12 fluid ounce metal beverage can 70 having a 2⅝ inch outside diameter resting on upper bulkhead 54. Nearly all 12 fluid ounce metal soda pop and beer cans are of this diameter, as are most 16 fluid ounce cans (they are merely higher); this fact determined the inside diameter of the fixture cylinder wall 31.

Figure 8:
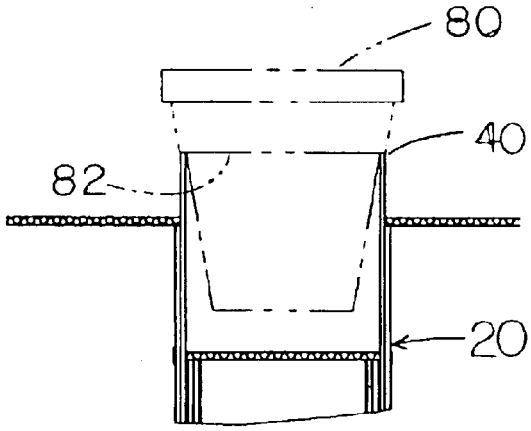
FIG. 8 is a view of the support fixture similar to FIG. 7, here shown supporting a representative polystyrene foam cup that has a step in the conical wall outer surface.

FIG. 8 is a view of support fixture 20 similar to FIG. 7, here shown supporting a polystyrene foam cup 80 that has a step 82 in the conical wall outer surface. The 8½ fluid ounce "Easy to Hold" style of polystyrene foam cup made by the Dart Container Corporation of Mason, Mich. has such a step that matches the rim 40 of cylinder wall 31, thus obviating the need for spacers underneath the cup (such as additional bulkhead disks 54) that would otherwise be required to prevent such a tapered cup from jamming inside the cylinder.

Figure 9:
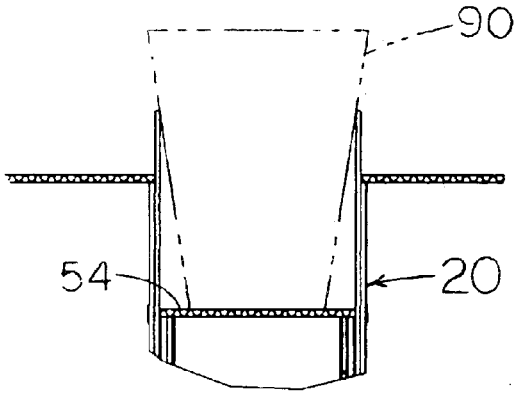
FIG. 9 is a view of the support fixture similar to FIG. 7, here shown supporting a representative thin-walled plastic tumbler.

FIG. 9 is a view of support fixture 20 similar to FIG. 7, here shown supporting a representative thin-walled plastic tumbler 90 leaving a small amount of clearance between the side of the tumbler 90 and cylinder rim 40. Tumbler 90 represented here matches the dimensions of the 9 fluid ounce Solo brand party cups manufactured by the Solo Cup Company of Urbana, Ill. Accommodating such tumblers determined the distance between the surface of upper bulkhead disk 54 and cylinder rim 40.

Figure 10:
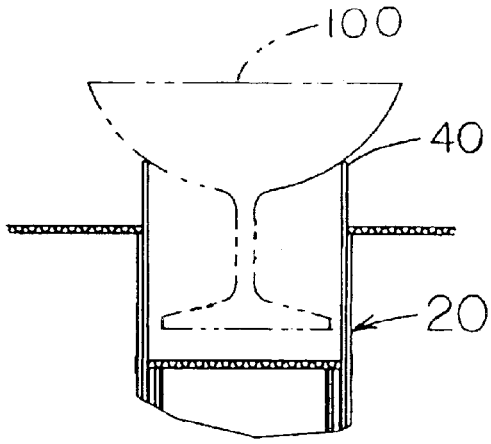
FIG. 10 is a view of the support fixture similar to FIG. 7, here shown supporting a representative stemmed wine glass.

FIG. 10 is a view of support fixture 20 similar to FIG. 7; here the illustration depicts a style of stemmed wine glass 100 (shown resting on cylinder rim 40) that could be accommodated.

Figure 11:
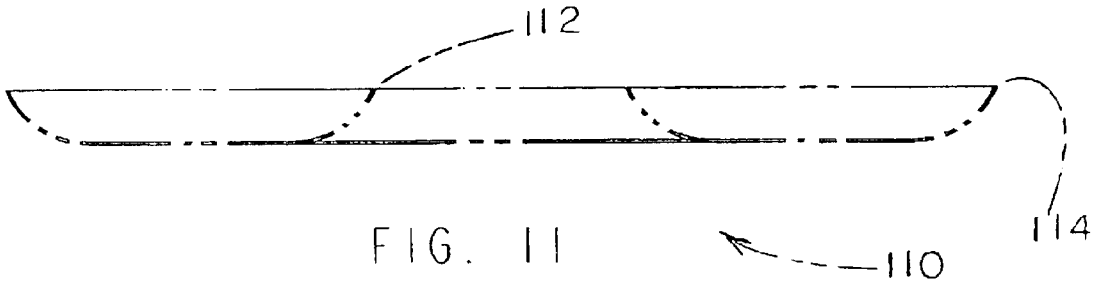
FIG. 11 is a representation of a food plate suitable for being supported by the support fixture, the food plate depicted having an OD/ID aspect ratio of an eleven inch diameter plate (this food plate is not part of the instant invention).

FIG. 11 is a representation of a food plate 110 having a flat bottom and an upwardly curving outer edge 114 and an upwardly curving inner edge 112 defining a three inch diameter central hole, suitable for being supported by support fixture 20 and depicted with an OD/ID aspect ratio corresponding to an eleven inch outside diameter (food plate 110 is not part of the instant invention, hence drawn with phantom lines).

Figure 12:
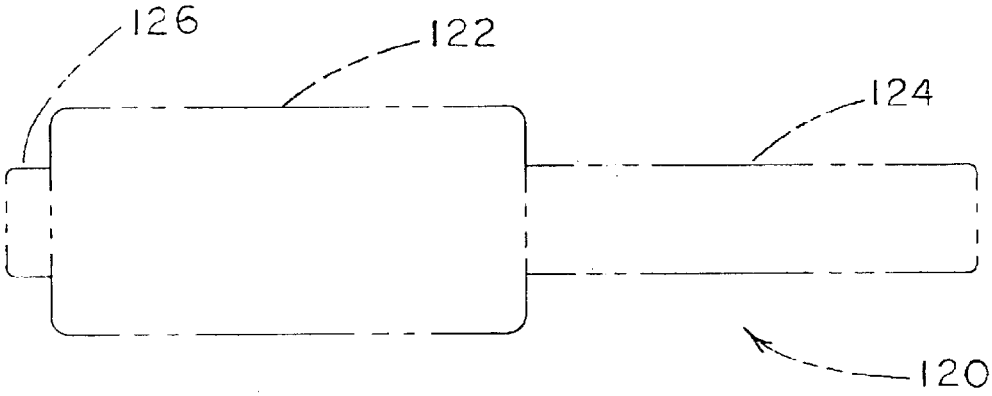
FIG. 12 is a representation of a cylindrical mandrel suitable for use in rolling the SF CF strip into two overlying wraps to form the cylinder wall (this mandrel is not part of the instant invention).

FIG. 12 is a representation of a cylindrical wooden mandrel 120 suitable for use as a tool in rolling SF CF strip 44 into two overlying wraps 32 and 34 to form the cylinder wall 31 (mandrel 120 is not part of the instant invention, hence drawn with phantom lines). Approximate dimensions for this tool are ¾ inch diameter by ½ inch long for stub 126, 2 21/32 inches diameter by 5¼ long for body 122, and 1¼ inch by 5 inches long for handle 124. Stub 126 would fit through lower bulkhead disk 50 to hold it in position during the rolling process; it would also aid in inserting upper bulkhead 54 into cylinder 31.

From the foregoing description, it will be apparent that the invention disclosed herein provides a novel and advantageous support fixture design. As will be understood by those familiar with the art, the invention may be embodied in other specific forms without departing from the spirit or essential characteristics thereof. Accordingly, the scope of the invention should be determined not by the embodiment illustrated, but by the appended claims and their legal equivalents.

I claim:

1. A hand-held corrugated-fiberboard support fixture for supporting a beverage container and for supporting a food plate having an approximately three inch diameter central hole, said support fixture comprising:

a generally flat planar plate-support platform cut from a sheet of double-face corrugated fiberboard, said platform having a lower surface and an upper surface and an inner edge defining a circular hole of predetermined size and a closed outer edge enclosing a surface area ranging between 15 to 300 square inches, said upper surface disposed to support a food plate;

a radially-symmetric cylindrical assembly having a lower end and an upper end and having a corrugated cylindrical outer surface disposed to be partially surrounded and gripped by the fingers and thumb of one hand, said cylindrical assembly further including:

a circular cylinder having a lower end and an upper end, said cylinder being a cylinder wall formed from an inner wrap and an over-lying narrower outer wrap of a single strip of single-face corrugated fiberboard, said cylinder wall having an outer corrugated surface with flutes running axially in the direction from lower end to upper end and an inner surface defining a central lumen of predetermined diameter, the upper end of said cylinder wall inner surface disposed to surround a lower portion of a beverage container, the lower end of said cylinder wall inner surface abruptly reduced in diameter by a folded-over ear of said inner wrap thereby forming an inner lip and ledge, said inner wrap protruding beyond said narrower outer wrap at the upper end of said cylinder wall to form a hub passing beyond a shoulder formed by the upper edge of said outer wrap, said hub disposed to fit through said circular hole in said plate-support platform and through a central hole in a supported food plate, said shoulder disposed to abut said plate-support platform lower surface;

a generally flat planar round lower bulkhead disk of predetermined diameter having a lower surface and an upper surface and a circular outer edge, said circular outer edge disposed to be surrounded by said cylinder wall inner surface, said lower surface disposed to be supported by said cylinder wall ledge, said upper surface disposed to support an axial spacer;

an axial spacer having a lower surface and an upper surface, disposed to be surrounded by said cylinder wall inner surface, said lower surface disposed to be supported by said lower bulkhead disk upper surface, said spacer upper surface disposed to support an upper bulkhead disk a predetermined distance above said lower bulkhead disk;

a generally flat planar round upper bulkhead disk of predetermined diameter having a lower surface and an upper surface and a circular outer edge, said circular outer edge disposed to be surrounded by said cylinder wall inner surface, said lower surface disposed to be supported by said axial spacer, said upper surface disposed to axially support a beverage container; and elastic means, surrounding said cylinder wall, for squeezing said inner wrap of single-face corrugated fiberboard between said outer wrap of single-face corrugated fiberboard and said outer edges of said lower and upper bulkhead disks.

2. The support fixture of claim 1 wherein said closed outer edge of said plate-support platform is circular and concentric with said circular hole of predetermined size, the diameter of the circular outer edge ranging from 5 to 19 inches.

3. The support fixture of claim 2 wherein said lower and upper bulkhead disks are each cut from a sheet of double-face corrugated fiberboard.

4. The support fixture of claim 3 wherein said elastic means for squeezing consists of two rubber bands, each rubber band surrounding said cylinder wall near each bulkhead location.

5. The support fixture of claim 4 wherein said axial spacer is a coiled strip approximately 2 inches wide by 16 inches long of single-face corrugated fiberboard.

6. The support fixture of claim 4 wherein said lower and upper bulkhead disks each have an approximately ¾ inch diameter central hole.

7. The support fixture of claim 5 wherein said lower and upper bulkhead disks each have an approximately ¾ inch diameter central hole.

8. A hand-held corrugated-fiberboard support fixture for supporting a beverage container and for supporting a food plate having an approximately three inch diameter central hole, said support fixture comprising:

a generally flat planar plate-support platform cut from a sheet of double-face corrugated fiberboard, said platform having a lower surface and an upper surface and an inner edge defining a circular hole of predetermined size and a closed outer edge enclosing a surface area ranging between 15 to 300 square inches, said upper surface disposed to support a food plate;

a radially-symmetric cylindrical assembly having a lower end and an upper end and having a corrugated cylindrical outer surface disposed to be partially surrounded and gripped by the fingers and thumb of one hand, said cylindrical assembly further including:

a circular cylinder having a lower end and an upper end, said cylinder being a cylinder wall formed from an inner wrap and an over-lying narrower outer wrap of a single strip of single-face corrugated fiberboard, said cylinder wall having an outer corrugated surface with flutes running axially in the direction from lower end to upper end and an inner surface defining a central lumen of predetermined diameter, the upper end of said cylinder wall inner surface disposed to surround a lower portion of a beverage container, the lower end of said cylinder wall inner surface abruptly reduced in diameter by a folded-over ear of said inner wrap thereby forming an inner lip and ledge, said inner wrap protruding beyond said narrower outer wrap at the upper end of said cylinder wall to form a hub passing beyond a shoulder formed by the upper edge of said outer wrap, said hub disposed to fit through said circular hole in said plate-support platform and through a central hole in a supported food plate, said shoulder disposed to abut said plate-support platform lower surface;

a cylindrical axial spacer of predetermined diameter and predetermined height made of rigid material, having a lower end and an upper end and a flat round lower surface and a flat round upper surface and a cylindrical surface spanning between said flat lower and flat upper surfaces disposed to be surrounded by said cylinder wall inner surface, said flat lower surface disposed to be supported by said cylinder wall ledge, said flat upper surface disposed to axially support a beverage container; and elastic means, surrounding said cylinder wall, for squeezing said inner wrap of single-face corrugated fiberboard between said outer wrap of single-face corrugated fiberboard and the cylindrical surface of said cylindrical axial spacer near the upper and lower ends of said spacer.

9. The support fixture of claim 8 wherein said closed outer edge of said plate-support platform is circular and concentric with said circular hole of predetermined size, the diameter of the circular outer edge ranging from 5 to 19 inches.

10. The support fixture of claim 9 wherein said elastic means for squeezing consists of two rubber bands, each rubber band surrounding said cylinder wall near each end of said cylindrical axial spacer.

11. A hand-held corrugated-fiberboard support fixture for supporting a beverage container and for supporting a food plate having an approximately three inch diameter central hole, said support fixture comprising:

a generally flat planar circular plate-support platform cut from a sheet of double-face corrugated fiberboard of 200 pounds per square inch burst test rating having size "C" flutes, said platform having a lower surface and an upper surface and an inner edge defining a central circular hole of approximately $2\frac{27}{32}$ inches in diameter and a circular outer edge ranging from 5 to 19 inches in diameter, said upper surface disposed to support a food plate;

a radially-symmetric cylindrical assembly having a lower end and an upper end and having a corrugated cylindrical outer surface disposed to be partially surrounded and gripped by the fingers and thumb of one hand, said cylindrical assembly further including:

a circular cylinder having a lower end and an upper end, said cylinder being a cylinder wall formed from an inner wrap and an over-lying narrower outer wrap of a single strip of single-face corrugated fiberboard, said single-face corrugated fiberboard having size "A" flutes and constructed of kraft paperboard having a basis weight within the range of 50-to 100 pounds per thousand square feet for both the fluted median and the facing, said single strip being bilaterally symmetrical and being approximately 7½ inches wide to form the inner wrap then stepped down to approximately 5 inches wide to form the outer wrap, said single strip being approximately 17¼ inches long overall, the narrower portion being approximately 9 inches long, said cylinder wall having an outer corrugated surface with flutes running axially in the direction from lower end to upper end and an inner surface defining a central lumen of approximately $2\frac{21}{32}$ inches in diameter, the upper end of said cylinder wall inner surface disposed to surround a lower portion of a beverage container, the lower end of said cylinder wall inner surface abruptly reduced in diameter by a folded-over ear of said inner wrap thereby forming an inner lip and ledge, said inner wrap protruding beyond said narrower outer wrap at the upper end of said cylinder wall to form a hub approximately 3 inches in diameter by approximately 1¼ inches long passing beyond a shoulder formed by the upper edge of said outer wrap, said hub disposed to fit tightly through said circular hole in said plate-support platform and through a central hole in a supported food plate, said shoulder disposed to abut said plate-support platform lower surface;

a generally flat planar round lower bulkhead disk of approximately $2\frac{21}{32}$ inches in diameter cut from a sheet of double-face corrugated fiberboard of 200 pounds per square inch burst test rating having size "C" flutes, having a lower surface and an upper surface and a circular outer edge, said circular outer edge disposed to be surrounded by said cylinder wall inner surface, said lower surface disposed to be supported by said cylinder wall ledge, said upper surface disposed to support an axial spacer;

an axial spacer made from a strip of approximately 2 inch wide by approximately 16 inches long single-face corrugated fiberboard wrapped into a coil, said coil disposed to be surrounded by said cylinder wall inner surface, the lower coil surface disposed to be supported by said lower bulkhead disk upper surface, the coil upper surface disposed to support an upper bulkhead disk approximately 2 inches above said lower bulkhead disk;

a generally flat planar round upper bulkhead disk of approximately $2\frac{21}{32}$ inches in diameter cut from a sheet of double-face corrugated fiberboard of 200 pounds per square inch burst test rating having size "C" flutes, having a lower surface and an upper surface and a circular outer edge, said circular outer edge disposed to be surrounded by said cylinder wall inner surface, said lower surface disposed to be supported by said axial spacer, said upper surface disposed to axially support a beverage container; and two number 64 size rubber bands each having a band cross section of approximately ¼ inch by $\frac{1}{32}$ inch and a flattened free length of approximately 3½ inches and meeting Federal Government General Services Administration Commercial Item Description A—A-131B, one rubber band surrounding said cylinder wall near said lower bulkhead location and one rubber band surrounding said cylinder wall near said upper bulkhead location, whereby said inner wrap of single-face corrugated fiberboard is squeezed between said outer wrap of single-face corrugated fiberboard and said outer edges of said lower and upper bulkhead disks.

12. The support fixture of claim 11 wherein said lower and upper bulkhead disks each have an approximately ¾ inch diameter central hole.

* * * * *